United States Patent [19]

Dawson

[11] Patent Number: 4,503,572

[45] Date of Patent: Mar. 12, 1985

[54] DISPOSABLE RECEPTACLE FOR SPITTLE

[75] Inventor: Patricia S. Dawson, Texhoma, Tex.

[73] Assignee: Spit Pit, Inc., Texhoma, Tex.

[21] Appl. No.: 419,817

[22] Filed: Sep. 17, 1982

[51] Int. Cl.[3] ..... A61J 19/00

[52] U.S. Cl. ..... 4/258; 220/23; 4/259

[58] Field of Search ..... 4/258, 259, 260; 220/23

[56] References Cited

U.S. PATENT DOCUMENTS

| | | | |
|---|---|---|---|
| 478,873 | 7/1892 | Koehler | 4/259 |
| 735,043 | 7/1903 | Tobin | 4/259 |
| 1,305,428 | 6/1919 | Wilson | 4/258 |
| 1,330,828 | 2/1920 | Wilson | 4/258 |
| 1,872,725 | 8/1932 | Gault | 4/258 |
| 2,063,559 | 12/1936 | Rogers | 4/258 |
| 2,126,701 | 8/1938 | Hamilton | 4/258 |
| 2,218,002 | 10/1940 | Hamilton | 4/258 |
| 3,629,879 | 12/1971 | Forst | 4/258 |

OTHER PUBLICATIONS

Photograph of Kuspa-Kup.

*Primary Examiner*—Henry K. Artis

*Attorney, Agent, or Firm*—Arnold, White & Durkee

[57] ABSTRACT

A disposable apparatus for disposal of spittle is disclosed which includes a receptacle having a top and a base. A lid including a disk-shaped member having an aperture of selected diameter disposed therethrough is attached by a channel member which is adapted to expand outwardly to allow passage of a lip of a receptable into the channel to secure the lid to the receptacle. A hollow truncated conical section extends from the lid into the receptacle.

6 Claims, 3 Drawing Figures

DISPOSABLE RECEPTACLE FOR SPITTLE

BACKGROUND OF THE INVENTION

The invention relates to receptacles for the disposal of spit, especially spitted tobacco waste from chewing tobacco and, more particularly, it relates to an improved disposable receptacle for spittle.

The best known receptacle for disposing of chewing tobacco waste is the brass spittoon which is depicted in western movies to have been a fixture in every saloon in the west. The brass spittoon provided an aesthetically acceptable solution to the problem of spit disposal, but suffered the disadvantage of having to be cleaned regularly.

With the recent return in popularity of chewing tobacco and snuff, the need for a suitable device similar to the spittoon has developed. Many people who now chew tobacco carry with them a coffee can or other can to spit into when they chew. The coffee can, being uncovered, is an unsanitary and aesthetically displeasing means of disposing of spit. Moreover, the coffee can is subject to being tipped over, spilling the contents onto adjacent surfaces. The resulting cleaning chore is unpleasant, at best.

A return to the spittoon for many users of chewing tobacco is also not feasible because of the cost of a suitable spittoon and because of the difficulty in gripping the typical spittoon. Moreover, the spittoon would still offer the problem of requiring periodic cleaning.

It is believed that as a promotional gimmick, a scaled-down heavy plastic facsimile of the spittoon has been produced with the brand names of the manufacturers of chewing tobacco and snuff printed on the side. Like its brass counterpart, however, the heavy plastic spittoon must be cleaned and is too expensive to simply throw away.

Accordingly, it is desirable to provide a receptacle for the disposal of tobacco waste from chewing tobacco and snuff and other spittle which is inexpensive enough so that it may be discarded without cleaning. It is also desirable to provide a receptacle which is basically spill-proof when it is tipped over.

SUMMARY OF THE INVENTION

The present invention overcomes the prior disadvantages through an apparatus for disposal of tobacco waste from chewing tobacco and other spittle comprising a receptacle comprised of a high polymer plastic. The receptacle has an aperture disposed on one side and includes a lip disposed around the aperture. A cover is provided comprised of a high polymer plastic and includes a mating channel shaped to snuggly fit onto the lip to detachably secure the cover onto the receptacle in an essentially fluid-tight seal. The cover further has an aperture disposed on its surface and includes a conical section, open at each end, shaped and adapted to extend from the aperture into the receptacle when the cover is secured onto the receptacle. The cover thereby provides communication from the outside of the receptacle into the receptacle.

In a preferred embodiment of the present invention, the conical section is shaped to extend into the receptacle when the cover is in place for a distance equal to one-half to three-fourths of the distance from the aperture to the side of the receptacle opposite the aperture.

In an alternative embodiment of the present invention, the receptacle is comprised of an expanded polystyrene plastic similar to styrofoam.

As still another alternative embodiment of the present invention, the receptacle is comprised of a paper treated with a water proofing agent such that the receptacle is fluid-tight to the tobacco.

In the most preferred embodiment of the present invention, the receptacle has a top and a base and is shaped to have a truncated, conical configuration slightly tapered inwardly from the top to the base. The receptacle is open at the top and includes a lip disposed around the top. A cover is provided comprised of high polymer plastic. The cover includes a mating channel shaped to snuggly fit onto the lip to removably secure the cover onto the receptacle and to form a substantially fluid-tight or leakproof seal between the receptacle and the cover at the lip. The cover has an aperture and includes a conical section open at each end adapted around the aperture and shaped to extend into the receptacle when the cover is in place on the receptacle. The conical section is further shaped to extend into the receptacle for a distance equal to from one-half to three-fourths of the distance from the top to the base.

In the most preferred embodiment, the receptacle is comprised of a high polymer plastic. The receptacle may also be comprised of styrofoam, paper treated with a water proofing agent, or another light weight, water (and tobacco) proof substance.

Accordingly, the present invention provides a receptacle which may be manufactured of an inexpensive, light-weight material suitable for disposal after each use. The receptacle provides a substantially leak-proof seal which minimizes the chance of spillage upon the tipping of the receptacle.

It is believed that the opportunity for spillage is diminished by the shape of the conical section of the cover which extends downwardly into the receptacle. In particular, if the amount of spit in the receptacle is small, upon the tipping of the receptacle, the spit will reside between the side of the receptacle and the conical section. It has further been found that when the receptacle is almost full, upon tipping of the receptacle, the fluid does not seek to back out of the conical section, but rather remains in the receptacle. It is believed that this phenomenon is caused by extending the conical section more than halfway into the receptacle and forming the fluid tight seal, such that a sort of a vacuum is created within the receptacle when the level of the fluid rises above the bottom of the conical section.

BRIEF DESCRIPTION OF THE DRAWINGS

This invention will further be illustrated by reference to the appended drawings which illustrate particular embodiments of the receptacle in accordance with this invention.

DESCRIPTION OF THE PREFERRED EMBODIMENTS

The preferred embodiment of the apparatus of the present invention is generally represented by a receptacle 12 and a cover 14 which is adapted to be detachably secured to the receptacle 12 to form a fluid-tight seal.

Figure 1:
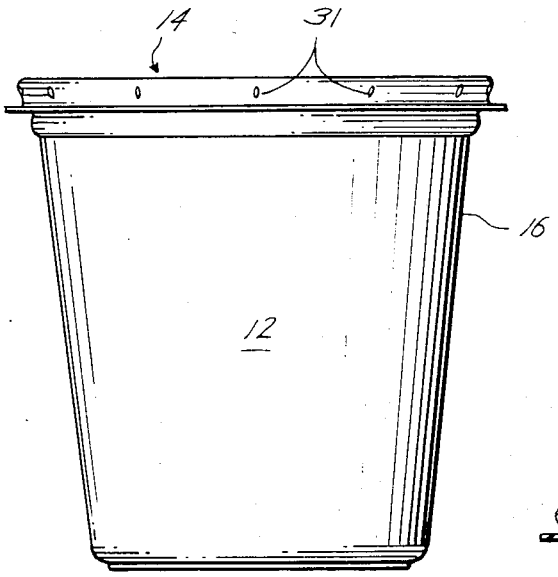
FIG. 1 is a side view of a receptacle in accordance with the present invention.
Figure 2:
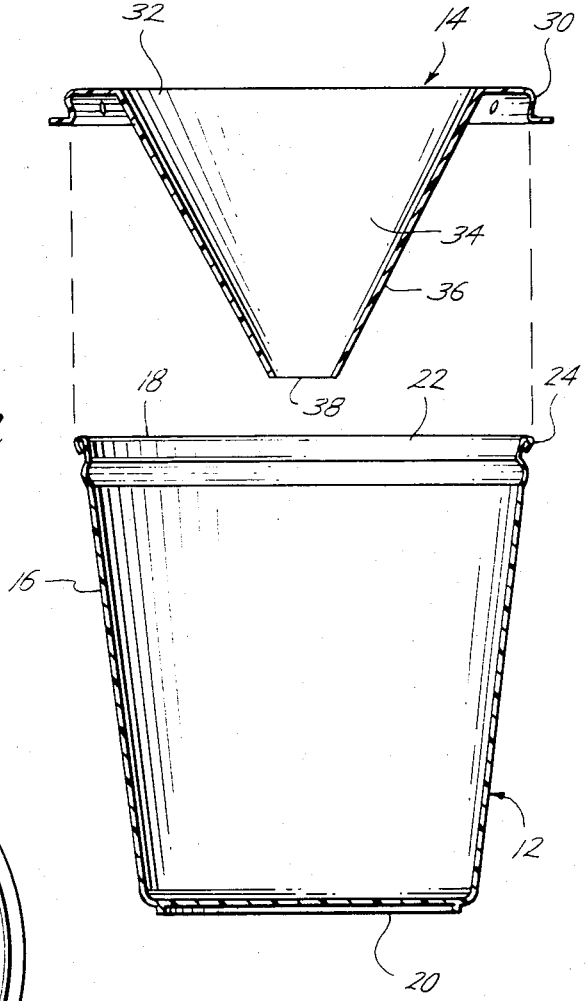
FIG. 2 is an exploded sectional view taken along the line II—II in FIG. 1.

Referring now to FIGS. 1 and 2, the receptacle 12 is shaped in the form of an inverted truncated cone, closed on the sides 16 and the bottom 20, but open at the top 18. The receptacle 12, of the preferred embodiment, thereby has a single upper aperture 22 located at the top 18. The sides 16 of the receptacle 12 taper slightly from the top 18 to the base 20.

In the preferred embodiment, the receptacle 12 is comprised of a thin, high-polymer plastic suitable for manufacture by blow molding or other manufacturing operation yielding to a high volume of product at low cost. It will be understood, however, that the receptacle may be comprised of an expanded polystyrene plastic, a paper treated to be waterproof or other waterproof material in accordance with the present invention.

The receptacle 12 further includes an outwardly turned lip 24 formed around the opening 22 at the top 18 of the receptacle 12. The lip 24 is adapted to form a gripping surface for a channel in the cover 14 which will be described below.

Figure 3:
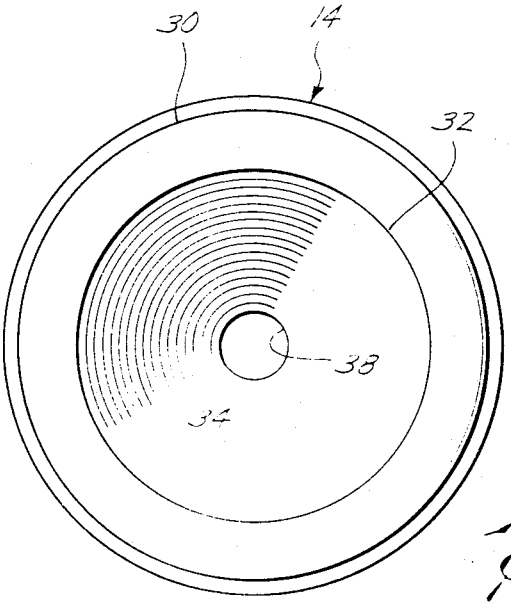
FIG. 3 is a top view of the receptacle shown in FIG. 1.

Referring now to FIGS. 1–3, the cover 14 has a generally flat, disk-shaped configuration and includes a locking channel 30 disposed around its outer perimeter. The channel 30 is shaped to form a mating recess to snuggly receive and mate with the lip 24 to detachably secure the cover 14 to the receptacle 12 and form a fluid-tight seal between the cover 14 and the receptacle 12 around the channel 30. The channel 30 may further include a plurality of projections 31 extending inwardly to the channel 30, the projections being formed on an elastic material whereby the channel 30 expands to allow passage of the lip 24 into the channel 30 and snaps back to engage the projections 31 beneath the lip 24.

The cover 14 further includes an aperture 32 to which is adapted a conical-shaped section 34. The conical section 34 is adapted such that the sides 36 of the section 34 taper inwardly from the aperture 32 and such that the section 34 extends downwardly in use into the receptacle 12. The conical section 34 is truncated at its lower end to form a lower aperture 38. The cover thereby provides communication by means of the aperture 32 and the aperture 38 between the interior of the receptacle 12 and the outside.

In the preferred embodiment, the aperture 32, aperture 38 and receptacle 12 are relatively disposed concentrically to each other when assembled. It will be understood, however, that the positioning of the apertures may be varied in accordance with the present invention.

It has been found in the preferred embodiment to be advantageous to extend the conical section 34 more than halfway into the receptacle 12. That is, the conical section 34 may be extended a distance equal to from one-half to three-quarters the distance from the top 18 to the bottom 20. As described above, it has been found that extending the conical section 34 into the receptacle 12 this distance helps to minimize spillage.

In the preferred embodiment, the receptacle 12 and the cover 14 are comprised of a high polymer plastic suitable for manufacture by vacuum-forming, blow molding, or other manufacturing process which accommodates high volume, low cost products. It will be understood, however, that other materials suitable for this objective may be utilized in accordance with the present invention.

The instant invention has been disclosed in connection with a specific embodiment. However, it will be apparent to those skilled in the art that variations from the illustrated embodiment may be undertaken without departing from the spirit and scope of the invention. For example, the shape of the receptacle 12 could be modified so long as a suitable aperture is provided for access of spit into the receptacle. Further, the cover 14 could be either permanently secured to or integrally formed with the receptacle 12 such that the apparatus of the present invention comprises a single part. These and other variations will be apparent to those skilled in the art and are within the spirit and scope of the present invention.

I claim:

1. A disposable apparatus for disposal of spittle, comprising:

(a) a receptacle having a top and a base and a known distance between the top and the base, the receptacle being shaped in a truncated conical configuration slightly tapered inwardly from the top to the base and open at the top, the receptacle further including a lip disposed around the top having a known outer diameter; and (b) a lid comprising:

(i) a generally disk-shaped member having an aperture of selected diameter disposed therethrough, the disk-shaped member having an outer diameter approximately equal to the outer diameter of the lip;

(ii) a channel member connected transverse to the disk-shaped member around the perimeter of the disk-shaped member such that the channel member extends on one side of the disk-shaped member, the channel member being comprised of an elastic material and being shaped to form a mating recess to snuggly receive and mate with such a lip of such a receptacle when the lid is attached to the receptacle, the channel member being further adapted such that the channel member expands outwardly to allow passage of such a lip of a receptacle into the channel when the lid is being attached to the receptacle and substantially returns to shape once such a lip is in place in the channel to form a substantially fluid-tight seal; and (iii) a hollow truncated conical section having a first open end of inner diameter substantially equal to the diameter of the aperture of the disk-shaped member and a second open end of inner diameter less than the diameter of the first open end, whereby the conical section has a tapered bore extending therethrough, the first open end of the conical section being secured to the disk-shaped member such that the bore aligned with the aperture and such that the conical section extends transversely from the disk-shaped member on the same side of the disk-shaped member as the channel member, the conical section further having a length of one-half to three-fourths of the distance from the top to the base.

2. The apparatus of claim 1 wherein the receptacle is comprised of a high polymer plastic.

3. The apparatus of claim 1 wherein the receptacle is comprised of an expanded polystyrene plastic.

4. The apparatus of claim 1 wherein the receptacle is comprised of paper treated with a waterproofing agent.

5. A lid for a receptacle such as a paper or plastic cup having a top and a base, the receptacle being open at the top and having an outwardly extending lip of known outer diameter disposed around the top, the lid comprising:

(a) a generally disk-shaped member having an aperture of selected diameter disposed therethrough; the disk-shaped member having an outer diameter approximately equal to the outer diameter of the lip;

(b) a channel member connected transverse to the disk-shaped member around the perimeter of the disk-shaped member such that the channel member extends on one side of the disk-shaped member, the channel member being comprised of an elastic material and being shaped to form a mating recess to snuggly receive and mate with such a lip of such a receptacle when the lid is attached to the receptacle, the channel member being further adapted such that the channel member expands outwardly to allow passage of such a lip of a receptacle into the channel when the lid is being attached to the receptacle and substantially returns to shape once such a lip is in place in the channel to form a substantially fluid-tight seal; and (c) a hollow truncated conical section having a first open end of inner diameter substantially equal to the diameter of the aperture of the disk-shaped member and a second open end of inner diameter less than the diameter of the first open end, whereby the conical section has a tapered bore extending therethrough, the first open end of the conical section being secured to the disk-shaped member such that the bore aligns with the aperture and such that the conical section extends transversely from the disk-shaped member on the same side of the disk-shaped member as the channel member.

6. The lid of claim 5 wherein the receptacle has a known distance between the top and the base in which the conical section has a length of between one-half to three-fourths of the distance between the top and the base of the receptacle.

* * * * *

UNITED STATES PATENT OFFICE

CERTIFICATE OF CORRECTION

Patent No. 4,503,572 Dated March 12, 1985

Inventor(s) Patricia S. Dawson

It is certified that error appears in the above-identified patent and that said Letters Patent are hereby corrected as shown below:

In the heading, after Appl. No., please delete "419,817" and insert therefor --419,187--.

In Column 4, line 56, please delete "aligned" and insert therefor --aligns--.

Signed and Sealed this

*Ninth* Day of *July 1985*

[SEAL]

*Attest:*

DONALD J. QUIGG

*Attesting Officer* *Acting Commissioner of Patents and Trademarks*